US007905349B2

(12) United States Patent
Campbell

(10) Patent No.: US 7,905,349 B2
(45) **Date of Patent: *Mar. 15, 2011**

(54) GOLF BAGS HAVING AN EXTERNAL PUTTER HOLDER AND/OR AN EXTERNALLY ACCESSIBLE GOLF BALL STORAGE SYSTEM

(75) Inventor: Derek Campbell, Clarksville, MD (US)

(73) Assignee: Nike, Inc., Beaverton, OR (US)

( * ) Notice: Subject to any disclaimer, the term of this patent is extended or adjusted under 35 U.S.C. 154(b) by 988 days.

This patent is subject to a terminal disclaimer.

(21) Appl. No.: 11/742,160

(22) Filed: Apr. 30, 2007

(65) Prior Publication Data

US 2008/0264814 A1 Oct. 30, 2008

(51) Int. Cl.
*A63B 55/02* (2006.01)
*A63B 55/00* (2006.01)

(52) U.S. Cl. ..... 206/315.5; 206/315.3; 206/315.6; 224/919

(58) Field of Classification Search ..... 206/315.5, 206/315.9, 315.3, 315.6; 224/919; 221/307
See application file for complete search history.

(56) References Cited

U.S. PATENT DOCUMENTS 1,483,475 A 2/1924 Osterhoudt
1,778,225 A * 10/1930 Morss ..... 206/315.9
1,829,093 A 10/1931 Hollins
1,845,088 A 2/1932 Hunerhoff
2,664,933 A 1/1954 Gielow
2,926,713 A 3/1960 Vaughan
3,215,181 A 11/1965 Reed
3,848,737 A 11/1974 Kenon
4,088,251 A 5/1978 Rodriguez
4,194,648 A 3/1980 Stanton
4,245,684 A 1/1981 Street et al.
4,416,404 A 11/1983 Daniels
4,798,319 A * 1/1989 James, Jr. ..... 224/251
4,838,416 A 6/1989 Carman
4,852,896 A 8/1989 Mills
4,881,638 A 11/1989 Cho
5,222,598 A * 6/1993 Yamazoe ..... 206/315.5
D385,113 S 10/1997 Beck et al.
5,725,095 A 3/1998 Beck et al.
5,775,513 A 7/1998 Anthony
5,816,396 A 10/1998 Shin
5,860,520 A 1/1999 Tang
5,988,379 A 11/1999 Yearous
6,029,850 A * 2/2000 Pate et al. ..... 221/64
6,053,386 A 4/2000 Reynolds
6,293,397 B1 9/2001 Chen
6,357,586 B2 3/2002 Pratt et al.
6,375,004 B1 4/2002 Tuerschmann et al.
6,439,424 B1 8/2002 Threadgill, Jr.
6,481,595 B1 11/2002 Chilton
D476,479 S 7/2003 Bailey
6,607,076 B1 8/2003 Smith
(Continued)

*Primary Examiner* — Sue A Weaver
(74) *Attorney, Agent, or Firm* — Banner & Witcoff, Ltd.

(57) ABSTRACT

Golf bags may include certain structures and features that allow easy and ready access to various pieces of golf equipment. Such golf bags may include: (a) a base; (b) one or more wall members extending from the base (defining a chamber for plural clubs); (c) a housing member located outside the chamber and defining a first aperture that provides access to a space outside the chamber for receiving a putter shaft; and (d) a ball storage compartment located outside the chamber and outside the housing member. The ball storage compartment, the housing member, and the first aperture may be arranged so that at least a portion of the space for receiving the putter shaft lies between the chamber and the ball storage compartment.

48 Claims, 7 Drawing Sheets

U.S. PATENT DOCUMENTS 6,615,982 B1 9/2003 Stewart et al.
6,640,970 B1 11/2003 Townsend, Jr.
6,712,205 B2 3/2004 Lee
6,758,334 B2 * 7/2004 Uner et al. ..... 206/315.3
7,111,731 B2 9/2006 Pratt et al.
7,628,270 B1 * 12/2009 Davis ..... 206/315.7
2005/0061691 A1 3/2005 Jansen et al.
2008/0264814 A1 10/2008 Campbell

* cited by examiner

GOLF BAGS HAVING AN EXTERNAL PUTTER HOLDER AND/OR AN EXTERNALLY ACCESSIBLE GOLF BALL STORAGE SYSTEM

FIELD OF THE INVENTION

This invention relates generally to golf bags. Golf bags in accordance with at least some examples of this invention include storage features outside of the main club holding chamber (e.g., for golf balls, putters, etc.) that allow users to efficiently insert objects to be stored and to quickly and easily locate and remove these objects from their storage compartments.

BACKGROUND OF THE INVENTION

The sport of golf stands as one of the most popular games in the world today. Technological innovations have been regularly improving almost every aspect of the game, including the equipment used to tote the golf clubs both on and away from the golf course. Golf carrying bags that were once made from heavy canvas and steel rods have been replaced by bags made from lighter, more durable composites, metals, plastics, and other materials.

Conventional golf bags often include one or more pockets or compartments in which various golf accessories may be carried. For instance, pockets often are provided to hold golf balls, golf tees, towels, ball markers, rain gear, and the like. Typically, the pockets or compartments are sized to hold a wide variety of different accessories, such as tees, ball mark repair tools, range finders, keys, wallets, money, sunscreen, other personal items, and/or balls. Often, this results in pockets that are oversized or undersized and result in users "fishing" through one or more pockets in an effort to locate the desired item(s).

In addition, golf bag compartments often are not conveniently positioned on the golf bag. For instance, pockets often are positioned such that a user can not reach one or more pockets when the bag is being carried and/or when the bag is placed on a pull cart or strapped to a motorized golf cart. This requires a user to manipulate the golf bag (e.g., twist it or remove it from his/her shoulder or the cart, shift its location on the shoulder or cart, etc.) in order to access the desired pocket. In addition, the pockets often are arranged such that, should a user be in a position to access a certain pocket while the bag is being carried, the contents of the bag and/or another pocket may spill.

BRIEF SUMMARY OF THE INVENTION

The following presents a simplified summary of the present invention in order to provide a basic understanding of some aspects of the invention. This summary is not an extensive overview of the invention. It is not intended to identify key or critical elements of the invention, nor is it intended to delineate the scope of the invention. The following summary merely presents some features and aspects of the invention in a simplified form as a prelude to the more detailed description that follows.

Aspects of this invention relate to golf bags for carrying and/or storing multiple golf clubs (e.g., on a golf course, during travel, etc.). Golf bags according to at least some examples of this invention may include: (a) a base; (b) one or more wall members extending from the base, wherein the wall member or members define an open end and a chamber for receiving a plurality of golf clubs; (c) a housing member located outside the chamber (e.g., integrally formed with one or more wall members, engaged with one or more of the wall members, etc.), the housing member defining a first aperture that provides access to a space outside the chamber for receiving a putter shaft; and (d) a ball storage compartment located outside the chamber and outside the housing member. The ball storage compartment, the housing member, and the first aperture may be arranged so that at least a portion of the space for receiving the putter shaft lies between the chamber and the ball storage compartment. The ball storage compartment further may include one or more apertures that open to a ball storage chamber. At least one of the apertures for the ball storage compartment may be constructed so as to provide easy user access to the stored balls without requiring manipulation of a mechanical closure system (such as a zipper, snaps, hook-and-loop fasteners, etc.). Golf bag structures of this type maintain various important and frequently accessed pieces of golf equipment readily available and easily accessible to the user.

BRIEF DESCRIPTION OF THE DRAWINGS

A more complete understanding of the present invention and at least some advantages thereof may be acquired by referring to the following description in consideration of the accompanying drawings, in which like reference numbers indicate like features, and wherein.

DETAILED DESCRIPTION OF THE INVENTION

Figure 1A:
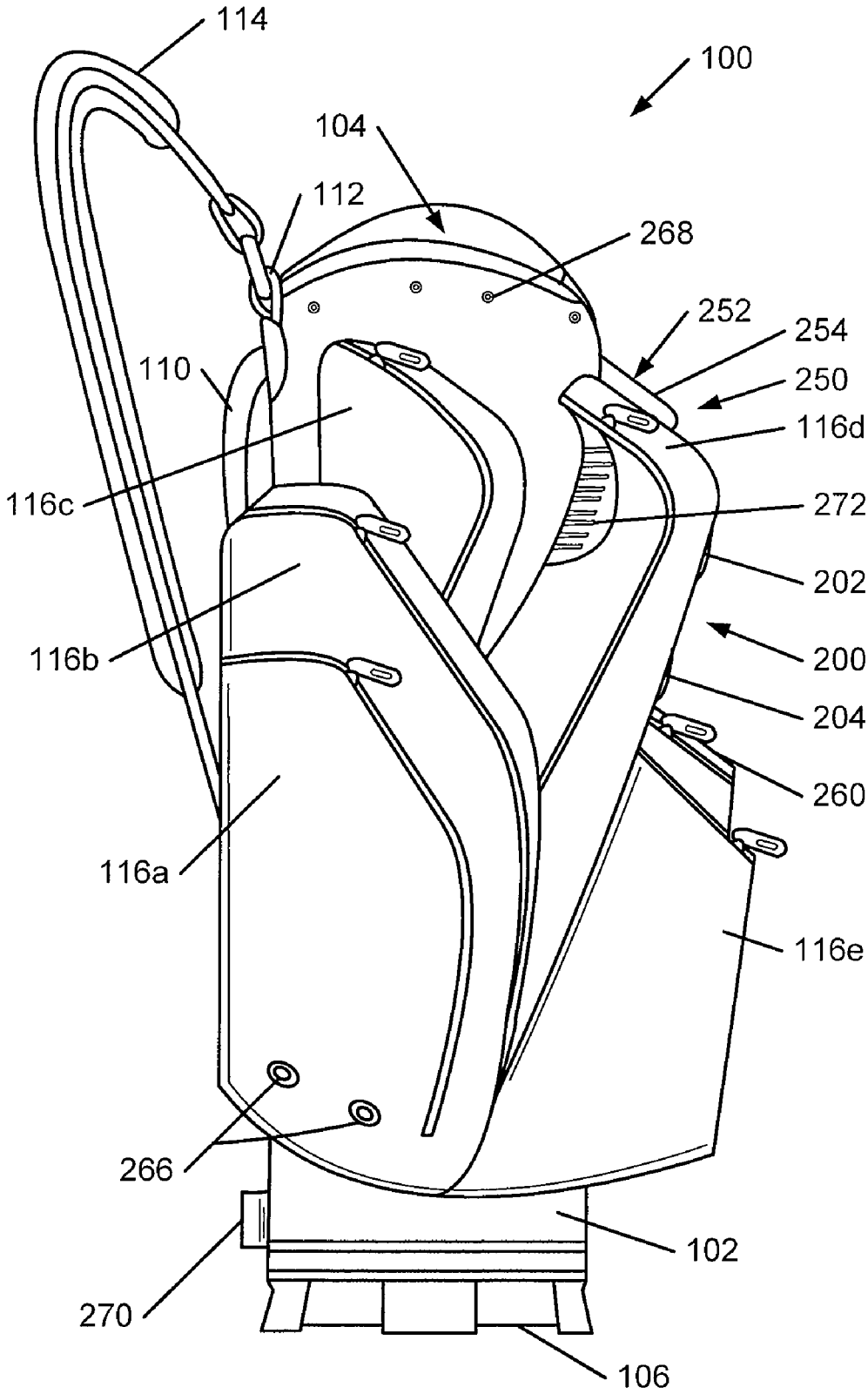
FIGS. 1A through 1C illustrate a golf bag structure according to one example of this invention.

In the following description of various examples of the present invention, reference is made to the accompanying drawings, which form a part hereof, and in which are shown by way of illustration various example embodiments in which the invention may be practiced. It is to be understood that other embodiments may be utilized and structural and functional modifications may be made from the specifically described structures without departing from the scope of the present invention.

I. GENERAL DESCRIPTION OF ASPECTS OF THIS INVENTION

Aspects of this invention relate to golf bags for carrying and/or storing multiple golf clubs (e.g., on a golf course, during travel, etc.). Golf bags according to at least some examples of this invention may include: (a) a base; (b) one or more wall members extending from the base, wherein the wall member or members define an open end and a chamber for receiving plural golf clubs; (c) a housing member located outside the chamber (e.g., integrally formed with one or more wall members, engaged with one or more of the wall members, etc.), the housing member defining a first aperture that provides access to a space outside the chamber for receiving a putter shaft; and (d) a ball storage compartment located outside the chamber and outside the housing member, wherein the ball storage compartment, the housing member, and the first aperture are arranged such that at least a portion of the space for receiving the putter shaft lies between the chamber and the ball storage compartment. The ball storage compartment further may include one or more apertures that open to a ball storage chamber. At least one of the apertures for the ball storage compartment need not include a mechanical closure system, e.g., so as to allow easy user access to the stored balls without requiring manipulation of a mechanical closure system, such as a zipper, snaps, hook-and-loop fasteners, etc. Golf bag structures of this type maintain various frequently used pieces of golf equipment readily available and easily accessible.

One or more of the ball storage compartment apertures may have a ball storage sleeve extending therefrom (e.g., to form a pocket that contains the golf balls in the ball storage compartment). The aperture(s) may be flexible and/or deformable between a first position that will not allow a golf ball to pass and a second position that will allow a golf ball to pass, so as to hold golf balls within the ball storage compartment against the forces of gravity but to allow their easily removal, e.g., when grabbed by a user.

Optionally, if desired, the ball storage compartment and the housing member making up the putter storage system may constitute an integral, unitary construction. Other elements may be included in this unitary constructions, such as an insulated chamber (e.g., that is not open to the ball storage compartment and/or to the space for receiving a putter shaft); elements for mounting one or more tees; elements for mounting one or more ball mark or divot repair tools; elements (such as pockets) for holding a writing instrument; etc. Such additional elements also may be provided as part of the golf bag structure separate from the ball storage compartment and/or the housing member.

The ball storage compartment and the aperture(s) defined therein may take on a wide variety of different sizes, shapes, structures, and/or arrangements without departing from this invention. For example, for apertures through which a golf ball may pass, a lower portion of the aperture may be wider than an upper portion of the aperture (when the golf bag is oriented in an upright manner). The ball storage compartment apertures, when two apertures are present, may be oriented such that one aperture is designed and positioned for ball insertion and one is designed and positioned for ball removal (e.g., the apertures may be vertically aligned or substantially vertically aligned when the golf bag is oriented in an upright manner).

As mentioned above, the ball storage compartment may include a sleeve extending from at least one aperture (and optionally connecting two apertures, when two are present) in which the balls are stored. This sleeve may extend in an axial direction away from at least one aperture, and the sleeve may define an internal open area perpendicular to the axial direction of less than 14 $in^2$, and in some example structures, having an open area of less than 9 $in^2$, or even less than 7 $in^2$ or less than 5 $in^2$. This internal sleeve open area, on the other hand, also may be at least 2.3 $in^2$, at least 2.4 $in^2$, at least 2.9 $in^2$, or even at least 3.2 $in^2$.

The sleeve (when present) also may have any desired length without departing from this invention. In some more specific examples, the sleeve may extend in an axial direction away from one aperture (and optionally to the other aperture, when two apertures are present) for a longitudinal length in the axial direction of at least 1.5 inches, and in some more specific examples, at least at least 3 inches, at least 4 inches, or even at least 5 inches. This longitudinal length dimension in the axial direction, in at least some example structures, also may be less than 8 inches, less than 6 inches, or even less than 5 inches.

Other dimensional features of ball storage compartment structures according to the invention are possible. For example, a distance between a lower portion of the upper aperture and an upper portion of the lower aperture may be at least 1 inch, and in some example structures, at least 1.5 inches, at least 3 inches, or even at least 4 inches. On the other hand, this distance between apertures (in structures where multiple apertures are present) may be less than 8 inches, less than 6 inches, or even less than 5 inches in some structures.

As another example, golf bags in accordance with at least some examples of this invention may include: (a) a main housing defining a main chamber for holding plural golf clubs; (b) a second housing adjacent an exterior surface of the main housing, wherein the second housing is integrally formed or engaged with the exterior surface of the main housing, and wherein the second housing defines an opening that provides access to a space outside the main chamber for receiving a putter shaft; and (c) a golf ball storage compartment provided at the exterior surface of the main housing, wherein the storage compartment includes a first flexible aperture and a second flexible aperture connected by an internal sleeve, wherein the first aperture is deformable between a first position that will not allow a golf ball to pass and a second position that will allow a golf ball to pass, wherein the second aperture is located at a position lower than the first aperture when the main housing is oriented in an upright manner, and wherein the second aperture is deformable between a first position that will not allow a golf ball to pass and a second position that will allow a golf ball to pass. The putter holding second housing and/or the golf ball storage compartment (including its aperture(s)) may have any of the various features, constructions, structures, and/or arrangements described above.

As yet another example, golf bag structures in accordance with at least some examples of this invention may include: (a) a main housing defining a main chamber for holding plural golf clubs; (b) a second housing adjacent an exterior surface of the main housing, wherein the second housing is integrally formed or engaged with the exterior surface of the main housing, and wherein the second housing defines an opening that provides access to a space outside the main chamber for receiving a putter shaft; and (c) a golf ball storage compartment provided at the exterior surface of the main housing, wherein the storage compartment includes a first aperture (and optionally more apertures), wherein the first aperture defines an opening having a longest longitudinal dimension extending in a first direction and a widest transverse dimension extending in a second direction perpendicular to the first direction. At least one aperture in this golf bag structure may be constructed such that, when in an unstressed condition, the longest longitudinal dimension is at least 1.75 inches and the widest transverse dimension is less than 1.65 inches. In the unstressed condition, the opening in the aperture retains a golf ball within the storage compartment against a force of gravity, but, when a golf ball located at the opening is exposed to an external, extra-gravitational pulling force (e.g., by a golfer attempting to grab the stored ball), the opening will expand, flex, or move under the pulling force so as to allow the golf ball to pass through the opening. The putter holding second housing and/or the golf ball storage compartment (including at least one of its aperture(s)) also may have any of the various features, constructions, structures, and/or arrangements described above without departing from this invention.

As still another example, golf bag structures in accordance with at least some examples of this invention may include: (a) a main housing defining a main chamber for holding plural golf clubs; (b) a second housing adjacent an exterior surface of the main housing, wherein the second housing is integrally formed or engaged with the exterior surface of the main housing, and wherein the second housing defines an opening that provides access to a space outside the main chamber for receiving a putter shaft; and (c) a golf ball storage compartment provided at the exterior surface of the main housing, wherein the storage compartment includes a first aperture providing access to the compartment, wherein the first aperture, in an unstressed condition, defines an opening having a longest dimension of at least 1.75 inches, and wherein, in the unstressed condition, the opening is sized and arranged such that a circle or sphere having a diameter of 1.68 inches will not fully fit within the opening. Again, the putter holding second housing and/or the golf ball storage compartment (including at least one of its aperture(s)) also may have any of the various features, constructions, structures, and/or arrangements described above without departing from this invention.

Given this general description of features, aspects, structures, and arrangements according to the invention, a more detailed description of specific example golf bag structures in accordance with this invention follows.

II. DETAILED DESCRIPTION OF EXAMPLE GOLF BAG STRUCTURES ACCORDING TO THE INVENTION

Specific examples of golf bag structures according to the invention are described in more detail below. The reader should understand, however, that these specific examples are set forth merely to illustrate examples of the invention, and they should not be construed as limiting the invention.

Figure 1B:
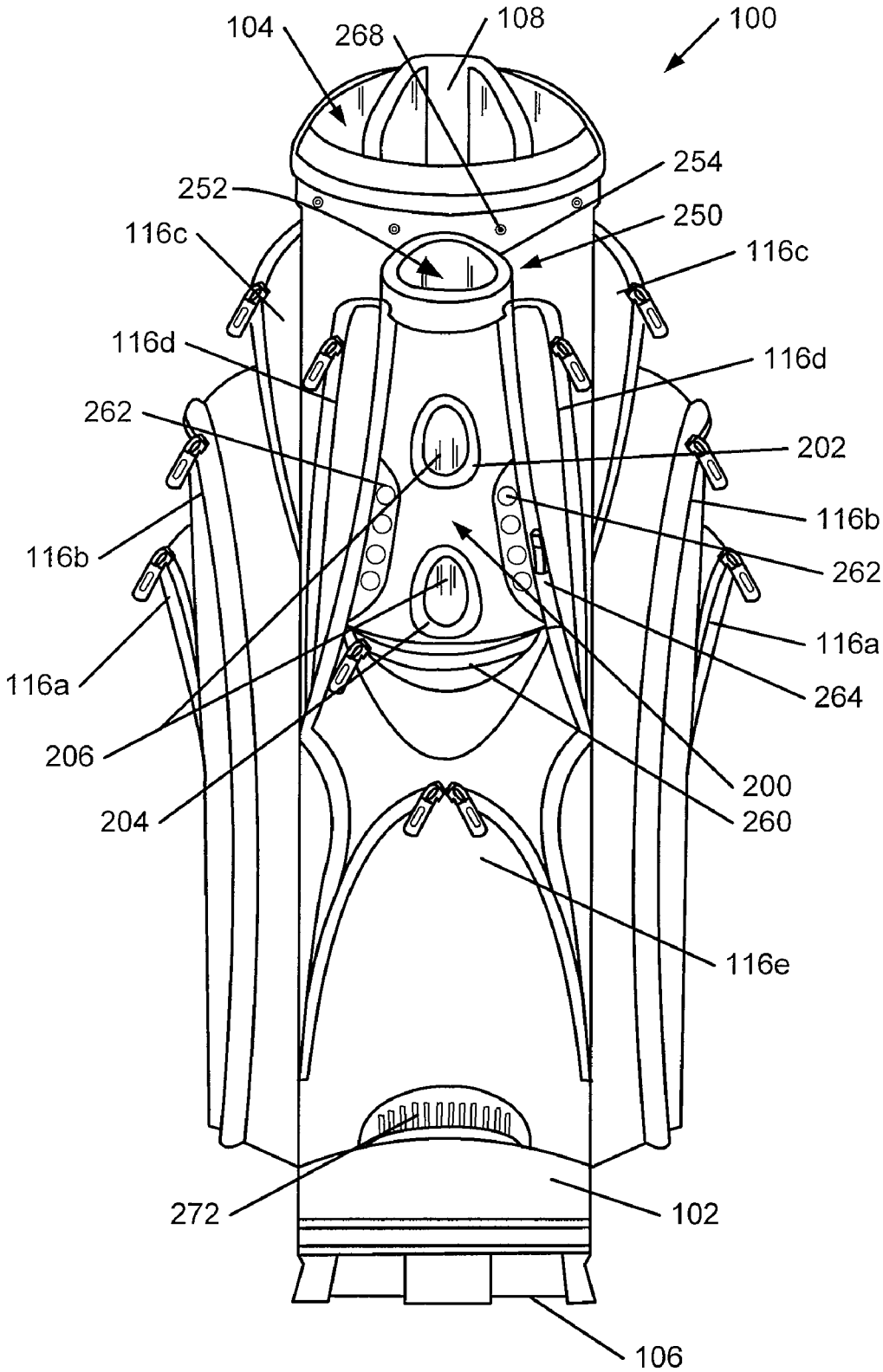
Figure 1C:
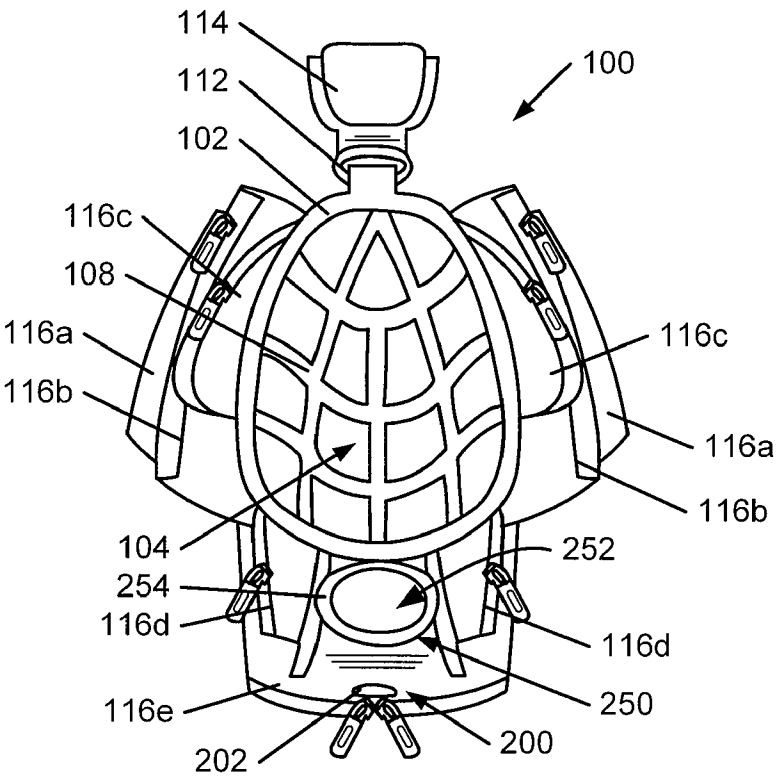

FIGS. 1A through 1C illustrate a golf bag 100 including one example arrangement of an external golf ball storage system 200 and an external putter storage system 250 in accordance with this invention. The golf bag 100 generally includes a housing 102 having one or more wall members that define a chamber 104 into which plural golf clubs may be placed. A base 106 is secured to or integrally formed with the housing 102 to provide support and a point of contact between the golf bag 100 and the ground. The base 106 may be arranged to allow the golf bag to stand up substantially upright and vertical, and/or other structures may be provided (e.g., extendable legs, a flexible base member 106, etc.) to enable the bag 100 to be stood up in an angled manner.

Housing 102 is a hollow structure with a generally elongate and tubular configuration for receiving golf clubs. A variety of materials, e.g., polymers, metals, textiles and the like, may form and/or be provided on the exterior of the housing 102 and/or may otherwise be used in the golf bag construction. One or more divider structures 108 may be secured at an upper end of the housing 102 in this golf bag structure 100, if desired, to define a plurality of compartments within chamber 104 and help keep the clubs separated from one another. When in use, shafts of golf clubs extend through the compartments and along the longitudinal length of the housing 102. Heads of the golf clubs remain visible, accessible, and generally at the top exterior of the golf bag 100. Divider 108 may be used to organize and prevent damage to the golf clubs. In this regard, divider 108 may be formed of a polymer or other material and/or may have a foam and/or textile sheath to provide a yielding and protective surface for contacting clubs. The divider 108 may extend the entire length of the chamber 104 (from the open end to the base 106) to further segregate the volume within the housing 102 and separate the various clubs, or it may extend only a portion of this length.

Golf bags according to examples of this invention may include additional features. For example, the bag 100 may include a handle 110 that assists with carrying golf bag 100, and it may include one or more points of attachment 112 for one or more shoulder straps 114. The golf bag 100 may include any desired type of strap arrangement, including one or two-strap carrying arrangements or other arrangements, without departing from the invention. Also, aspects of this invention, including the external putter storage system 250 and/or the golf ball storage system 200 may be used with any desired type golf bag construction, including a carry type bag (e.g., lightweight and generally smaller), a cart type bag, and the like, including general golf bag constructions and types as are conventionally known and used in the art.

The golf bag 100 of FIGS. 1A through 1C also includes a plurality of compartments or pockets 116*a*-116*e* distributed around the exterior of the housing 102. The pockets 116*a*-116*e* may vary in size and number, and they generally may provide substantially enclosed regions in which various golf accessories, such as golf tees, balls, towels, rain gear, range finders, and the like, as well as personal items, may be stored. The pockets 116*a*-116*e* generally are enclosed on at least one side by a zipper, a hook-and-loop fastener, a snap fastener, a tie fastener, or other type of fastener or closure system to prevent objects within the pockets 116*a*-116*e* from spilling out.

As noted above, this illustrated golf bag structure 100 further includes an exterior golf ball storage system 200. The golf ball storage system 200 is engaged or integrally formed with the housing 102 on an exterior portion of the housing 102. The golf ball storage system 200 may be engaged with the housing 102 using any of various known methods of attachment, such as stitching, adhesives, mechanical fasteners (e.g., rivets, etc.), etc. Alternatively, if desired, the golf ball storage system 200 may be integrally formed as part of the structure making up some portion of the overall golf bag structure 100, such as formed in or on one or more of the pocket members 116*a*-116*e*, formed in or on the material and/or structures making up the exterior of the housing 102, etc. The golf ball storage system 200 of this specific example structure 100 generally includes an upper aperture 202, a lower aperture 204, and an internal sleeve 206 connecting the upper and lower apertures 202 and 204, respectively. The various components and structures making up the storage system 200 will be explained in more detail below.

Figure 2A:
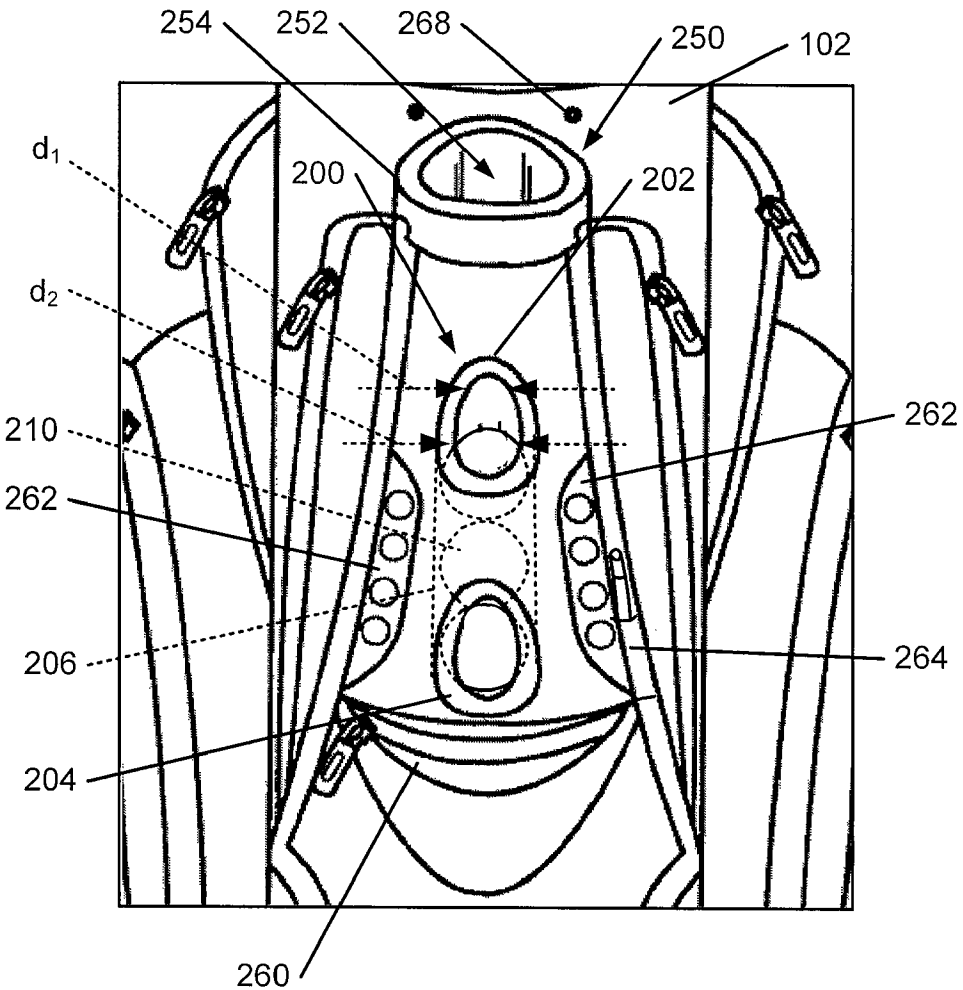
FIGS. 2A through 2C illustrate more details of potential features of golf bag structures according to at least some examples of this invention.

The golf ball storage system 200 and its various components may have a wide variety of sizes, shapes, constructions, and/or arrangements without departing from this invention. The upper aperture 202 of this illustrated example structure 200 generally is shaped to accommodate the shape and a portion of the size of a golf ball (note also FIG. 2A). For instance, upper aperture 202 may be circular, triangular, elliptical, etc. In the arrangement shown, upper aperture 202 is substantially oval in shape or egg shaped. In one arrangement, a lower portion of the upper aperture 202 may be wider than an upper portion of the upper aperture 202. For example, as illustrated in FIG. 2A, the width $d_1$ of the upper portion may be narrower than the width $d_2$ of the lower portion. These features of the aperture 202 provide an opening that is sized to retain a golf ball at the lower portion and sized to accommodate the user in inserting the ball into the sleeve 206 at the upper portion. For instance, the upper portion may be sized to accommodate a user's finger such that when a user inserts a ball into the upper aperture 202, the user may place the ball at the lower portion of the upper aperture 202. In doing so, the user's finger may extend through the upper portion of the aperture 202 as the ball is pushed through the upper aperture 202.

If desired, the shape of the upper aperture 202 also may aid in properly aligning a ball for insertion into the golf ball storage system 200. For instance, a user may place the ball on the upper portion of the upper aperture 202 where the aperture is generally too narrow to accommodate the ball. However, the shape and configuration of the upper aperture 202 may cause the ball to roll, slide, or otherwise move downward to the wider, lower portion. While the lower portion may be of sufficient width to allow free entry of a ball into the sleeve 206 (e.g., wider than 1.68 inches), alternatively, the lower portion of the aperture 202 may be somewhat smaller than a typical golf ball diameter, but it may stretch, flex, compress, or expand sufficiently to allow the ball to pass into the storage system 200.

In one example arrangement, the upper aperture 202 may be formed, at least in part, from a flexible material in order to allow it to stretch, compress, flex, or otherwise expand when a ball is pushed against it under force, to thereby allow the ball to pass through the aperture 202 and into the sleeve. For example, the outer rim of the aperture 202 may be formed of an elastomeric material (such as rubber, a foam material, etc.) that allows the aperture 202 to compress, flex, and/or move to accommodate the size of the golf ball when a user inserts a ball into the golf ball storage system 200 and that contracts back to or toward its original size and shape so as to ensure the ball does not fall out of the storage system 200 when the balls are simply being carried in the storage system 200.

The golf ball storage system 200 of this example structure 100 also includes a lower aperture 204, from which golf balls can be removed from the golf ball storage system 200. The lower aperture 204 generally may be any desired shape to accommodate removal of a golf ball from the golf ball storage system 200. For instance, the lower aperture 204 may be circular, oval, and the like. In this illustrated example, the lower aperture 204 has substantially the same shape as the upper aperture 202. This shape provides a relatively wide lower region to allow removal of a golf ball from the sleeve 206, as well as a relatively narrow upper region that allows a user to reach a finger, such as his index finger, through the aperture 204 to contact and retrieve a ball. Once the user's finger(s) reaches around, contacts, and/or grasps the ball on the interior of the storage system 200, the ball can be pulled outward by the user's finger(s) and through the aperture 204.

Similar to the arrangement of the upper aperture 202, the lower aperture 204 also may be formed of a flexible material, such as an elastomeric material (e.g., rubber, a foam material, etc.). This flexible arrangement may allow the lower aperture 204 to flex, stretch, compress, and/or expand to allow the golf ball and/or finger to fit through when a user is attempting to remove a ball, and it will contract when a user is not attempting to access the balls to prevent any balls from spilling out of the golf ball storage system 200. Additional example features and structures of aperture 202 and/or aperture 204, including their flexibility and/or stretchability, will be described in more detail below.

As noted above, golf bags 100 in accordance with examples of this invention further may include an external putter storage system 250 so that the player's putter can be held in a compartment 252 separate from the housing 102 and chamber 104 for the plurality of golf clubs. This feature keeps the putter, which is a frequently used club, in a consistent and readily accessible location for the user. This feature also allows the main housing 102 of the golf bag 100 to be made somewhat taller without fear that the putter (which is typically one of the shortest clubs) will slip down into the bag interior 104 and be difficult to locate and/or retrieve. Also, because the putter often is shorter than other clubs, it can tend to get lost in the main housing 102 of the golf bag 100 among the several other stored clubs. The putter storage system 250 of this invention can help users quickly and reliably position and the putter in the bag and can help users quickly and reliably find the putter within the bag 100.

The putter storage system 250 in this illustrated example structure 100 includes a housing member 254 defining an opening or aperture through which the grip end of a putter shaft may be inserted. The housing member 254 may be made from a relatively rigid plastic or other material (such as a polyester, etc.) that is integrally formed with or engaged with an exterior surface of one or more of the wall member(s) making up the main housing 102 of the bag 100. Optionally, if desired, the ball storage compartment 200 (including its aperture(s) 202 and/or 204) may be integrally formed with or connected with the housing member 254 of the putter storage system 250. Alternatively, if desired, the ball storage compartment 200 may fit around at least some portion of an exterior of the putter storage system 250. In any event, in at least some golf bag structures in accordance with this invention (including the structure 100 illustrated in FIGS. 1A through 2C), the golf ball storage system 200 and the putter storage system 250 may be structured and arranged such that at least a portion of the space for receiving the putter shaft in the putter storage system 250 (e.g., the space below the aperture in housing 254) lies between the main housing 102 for containing the plural golf clubs and the ball storage compartment 200.

Figure 2B:
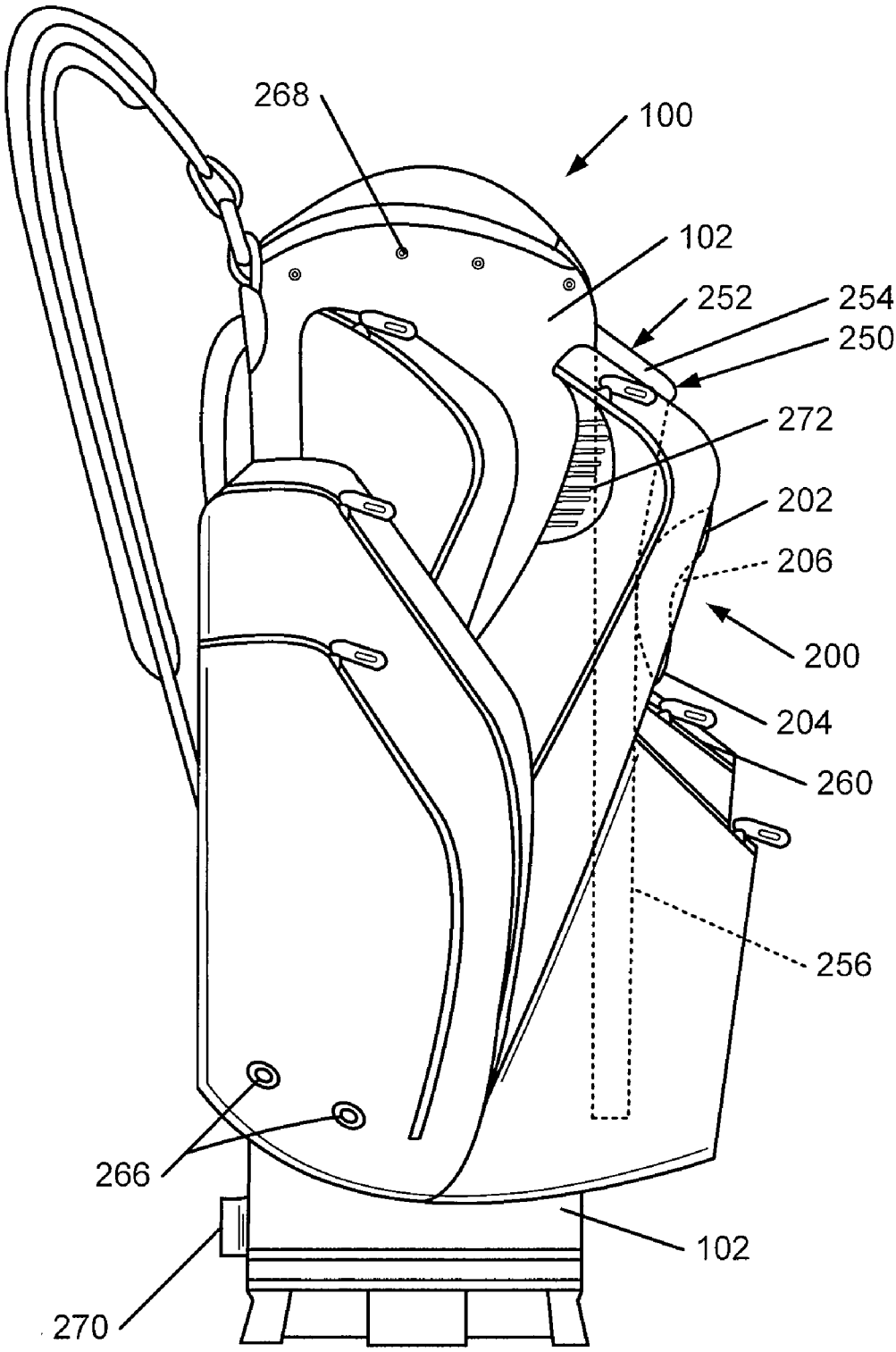
Figure 2C:
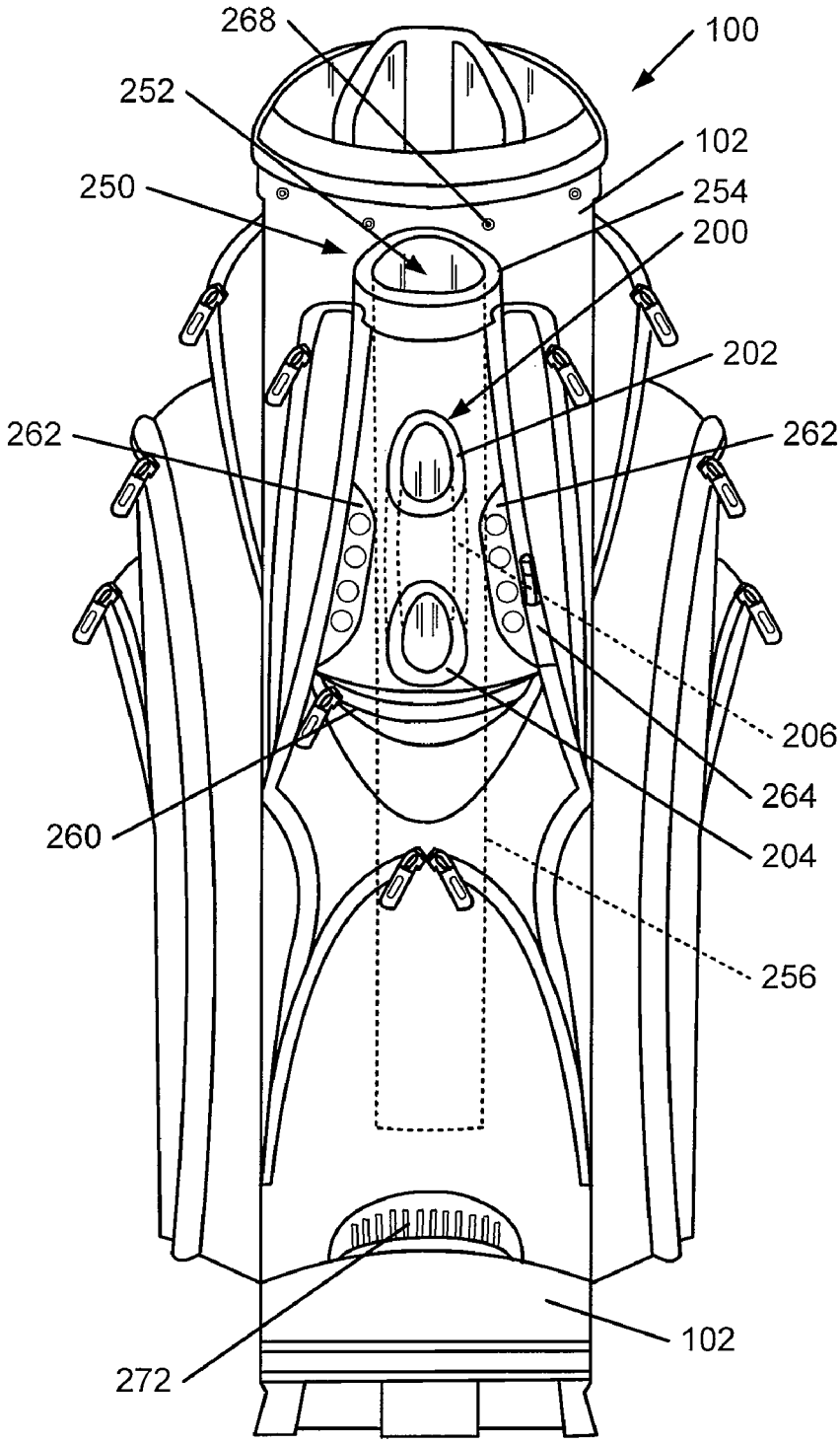

The space defined in the putter storage compartment 252 for receiving the putter shaft (accessible through the opening in housing member 254) may have any desired shape or construction without departing from this invention. For example, as illustrated in FIGS. 2B and 2C, the opening in the housing member 254 may open or extend into an elongated tube structure 256 that may extend generally parallel to the wall(s) of housing member 102 of the main golf bag structure 100. The tube structure 256 may extend any desired longitudinal length along the wall of the housing member 102 without departing from this invention (e.g., the tube structure 256 may be of a length such that the free end of the putter grip rests on a bottom wall (if any) of the tube structure 256, or it may be of a sufficient length so that the head or other part of the putter structure contacts the housing member 254 to prevent further movement of the putter into the tube structure 256. If desired, due to its generally vertical construction and open top, the tube structure 256 may include a drain member to allow any captured water to easily exit the tube 256 without substantial accumulation or soaking.

Other variations in the putter storage system structures 250 are possible without departing from this invention. For example, the opening in the housing member 254 may open to an open structure that simply constitutes free space located between the ball storage compartment 200 (and optionally at least some of the pocket members (e.g., pocket members 116*d* and 116*e* in FIGS. 1A through 1C) and the wall member(s) of the housing 102). In other words, the housing member 254 may be sized and shaped so as to define the opening for receiving the putter shaft (e.g., a few inches), and then the housing member 254 may terminate to an interior open space (without tube structure 256). The putter shaft may simply extend into this open space.

The arrangement of the putter storage system 250 as illustrated in FIGS. 1A through 2C can provide certain advantages. For example, in this illustrated example, the putter storage system 250 is somewhat tucked in between the various pockets and/or the ball storage 200 and the main housing 102 of the bag 100. This arrangement efficiently uses the available space without making the bag excessively bulky and without making the putter storage system 250 appear to jut out from the main housing 102. This arrangement also can produce an aesthetically pleasing golf bag structure.

Golf bag structures in accordance with at least some examples of this invention may include still additional features, if desired. For example, as illustrated in FIGS. 1A through 2C, the golf bag structure 100 may include a cooler pocket 260. The interior of this pocket 260 may be lined with a waterproof and/or thermally insulative material to allow materials contained therein to be kept warm and/or cold and to prevent moisture from leaking to other parts of the bag structure. While the cooler pocket 260 may be provided at any desired location in the golf bag structure 100, in this illustrated example, it is located immediately beneath the lower aperture 204 of the ball storage compartment 200. Also, if desired, the cooler pocket 260 may be any desired size without departing from this invention. In this illustrated example structure 100, the interior of the cooler pocket 260 may extend downward and into the area of pocket member 116*e* (e.g., enclosed within the interior of pocket member 116*e*). Additionally, if desired, the cooler pocket 260 may include one or more drain members to allow any accumulated water to freely drain out.

If desired, in some golf bag structures according to the invention, portions of the golf bag may be constructed as a unit or integrated overall structure. For example, in the golf bag structure 100 illustrated in FIGS. 1A through 2C, some portions or all of the putter storage system 250 and the golf ball storage system 200 may be formed or constructed as a unitary structure (e.g., from a flexible polymeric material, from a rigid polymeric material, from various materials combined or joined together, etc.). This unitary structure further may include at least some portions of the cooler pocket 260, one or more of the pocket members (e.g., pocket members 116*d* and/or 116*e*), and/or other features of the golf bag 100. In at least some examples, this unitary structure may be provided on a front portion of the golf bag (e.g., the front from a player's point of view when the bag 100 is mounted on a power cart or a hand cart for typical use). In this manner, the bag 100 can provide convenient storage and ready access to many of the most frequently used items during a round of golf (e.g., balls in ball storage compartment 200, the putter in putter storage system 250, tees in tee storage areas 262, pens or pencils in storage pocket 264, beverages or snacks in cooler pocket 260, etc.). As yet another example, if desired, the unitary structure may include all of the putter storage system 250, the golf ball storage system 200, the cooler pocket 260, the other pocket members 1116*a* through 116*e*), the tee storage area 262, and the pencil storage pocket 264.

The various pockets (e.g., 116*a*-116*e*), the putter storage system (e.g., 250), and/or the golf ball storage system (e.g., 200) may be engaged with the golf bag housing 102 in any desired manner without departing from this invention, including the manner in which these or similar objects and structures are connected with conventional and known golf club bag structures (e.g., using rivets or other mechanical connectors, via stitching, via adhesives or cements, etc.). The golf bag structure 100 further may include additional features as are known and used in the golf bag art, such as one or more pocket vents 266 (e.g., metal eyelets), snaps or other connectors 268 for engaging a separate cover member (for covering compartment 104), umbrella holders (see bottom portion 270), and the like.

The example golf bag structure 100 illustrated in FIGS. 1A through 2C further includes handle structures 272 at various locations around the bag. More specifically, in this illustrated example structure 100, handle structures 272 are provided at each side of the bag, near its top, in the side edges of pocket member 116*d* along each side of the aperture 252 for the putter storage compartment 250. An additional handle member 272 is provided in this bag structure 100 near the bag bottom, formed at the bottom exterior of pocket member 116*e*. Because of the front located structures in this golf bag 100, including the ball storage compartment 200, the putter storage system 250, the cooler structure 260, and the front pocket 116*e*, bags of this type often are stored for travel laying on their sides (e.g., such that the above mentioned structures face upward or rotated to one side, not directly downward). One or more of the handles 272, e.g., at the positions described above, can help users better grasp the bag and move it from a laying position (e.g., when lying in a vehicle trunk, from storage, etc.).

Any desired handle structure may be provided without departing from this invention. For example, the handle 272 may be rigid or flexible. As some more specific examples, the handle 272 may constitute a flap or other piece of material provided in the textile or other material making up the exterior of the pocket member at which the handle is located. As another example, the handle 272 may constitute an opening cut through the textile or other material making up the exterior of the pocket member in which the handle is formed. As still another example, if desired, the handle 272 may be formed as a gap or recess between the housing 102 and the textile or other material making up the associated pocket member. As still additional examples, the handle 272 may constitute a separate element mechanically engaged with the golf bag structure 100 (e.g., engaged with the housing 102, engaged with a pocket member, engaged with the ball storage compartment 200, engaged with the putter storage system 250, engaged with the cooler structure 260, etc.). The handle members 272 may be the same or different from one another (when plural handle members are present), and they may be made from any desired materials, including metals, polymeric materials, textile materials, etc. Optionally, if desired, the handle members 272 may be made from and/or include (e.g., be at least partially coated with) some sort of grip enhancing, comfort enhancing, or reinforcing material, such as a rubber, vinyl, fabric, foam, or other polymer material. Any desired handle structure may be provided on a golf bag structure 100 without departing from this invention.

Referring again to FIGS. 1A through 2C, additional example features of this example golf bag 100, and particularly the golf ball storage compartment 200, will be described. As illustrated in these figures, the upper aperture 202 and lower aperture 204 of the golf ball storage system 200 may be connected by an interior sleeve 206 (shown in broken lines in FIGS. 2A through 2C). The sleeve 206 may be arranged so that it is on the interior of the golf bag housing 102, in the interior of a pocket (e.g., pockets 116*a*-116*e*), and/or between a pocket and an outer external material of the golf bag 100, such that it is generally not visible from the exterior of the bag 100 (the apertures 202 and 204, on the other hand, in this example structure 200, will remain open, visible, and easily accessible from the exterior of the bag 100). The sleeve 206 also may extend in an area in front of the space for the putter shaft in putter storage system 250 and an outer cover structure of the unitary structure joining the putter storage system 250 and the ball storage system 200. The sleeve 206 may have a substantially tubular configuration, e.g., with a round, oval, elliptical, or other cross sectional shape, and it may be sized to accommodate an object with a diameter approximately the size of a golf ball. The sleeve 206 also may be arranged in a substantially vertical configuration (e.g., angled less than 15 degrees, or even less than 10 degrees) when the bag 100 is in a standing and vertically upright position (as illustrated in the figures), thereby arranging any balls contained within the holder 200 in a substantially vertical, stacked arrangement. As some more specific examples, the sleeve 206 may have a substantially round cross section, the diameter of that cross section being at least slightly larger than a golf ball, to allow balls to be stored in a single-file, stacked arrangement. The stacked, single-file, vertical arrangement of the balls within the storage system 200 may aid a user in retrieving balls because these balls are contained within a designated and easily accessible ball containing area and within an area allowing minimal movement of the balls. These features may substantially eliminate a user having to search or "fish" through a pocket to locate and remove a ball, thereby speeding play, reducing user frustration, etc.

The sleeve 206 also may be constructed so as to have any desired length (e.g., longitudinal length in the axial direction, as will be explained in more detail below), e.g., within the parameters of the compartment, pocket, or other structure on the golf bag 100 in which it is (at least partially) contained and/or on which it is formed. In the specifically illustrated examples of FIGS. 1A through 2C, the sleeve 206 generally extends between and spans the distance between the upper aperture 202 and lower aperture 204, thereby forming a tubular or cylindrical structure having an axial length. For example, the length of the sleeve 206, and consequently the number of balls the holder 200 can retain, may be determined by the available distance between the upper aperture 202 and lower aperture 204. This feature will be described in more detail below in conjunction with FIG. 6.

The interior sleeve 206 may be formed of any suitable or desired material, including rigid or flexible materials, such as nylon or other polymeric, textile, and/or fabric materials. In one example arrangement, the interior sleeve 206 may be formed of a water-resistant or waterproof material to prevent moisture from seeping into an interior compartment or pocket or into the interior 104 of the bag through the sleeve 206. More specifically, because the apertures 202 and 204 may remain open and exposed to the external environment, rain or moisture/water from other sources may enter the sleeve 206 through these open apertures 202 and/or 204. Use of a waterproof or hydrophobic material within the sleeve 206 can help prevent this moisture/water from further entering the compartment (e.g., a pocket 116*a*-116*e*) or into the housing 102. In addition, the substantially vertical arrangement of the interior sleeve 206, when present in this manner, may help prevent rain water and other moisture/water from pooling in the golf ball storage system 200. Rather, any rain water or other moisture/water that may enter the sleeve 206 through the apertures 202 and/or 204 is likely to drain through the lower aperture 204. If desired, a drain mechanism may be provided to further help the sleeve 206 drain.

In order to place a ball 210 into this example golf ball storage system 200, a user may place the ball 210 in contact with the upper aperture 202. The user then may push the ball 210 inward, toward the sleeve 206, which causes the upper aperture 202 to expand or flex and forces the ball 210 through the aperture 202. Once the ball 210 is substantially through the upper aperture 202, the upper aperture 202 will contract and the ball 210 then will be contained within the interior sleeve 206. At this point, gravity may cause the ball 210 to roll or fall from the upper aperture 202, downward through the sleeve 206, to or toward a position adjacent the lower aperture 204, as shown in FIG. 2A. The contracted and unstressed position of the lower aperture 204 will keep the ball 210 from falling out of the golf ball storage system 200. Additional balls 210 may be added using this same method. Each ball 210 may be forced through the upper aperture 202 and gravity (or the force of another entering ball) will cause the lower balls to move to or toward a position on top of the balls 210 already in the interior sleeve 206 of the golf ball storage system 200 and to or toward the lower aperture 204.

In order to remove a ball 210 from the golf ball storage system 200, a user may insert one or more of his fingers into the lower aperture 204 to make contact with a ball 210. The user's finger(s) may force the lower aperture 204 to expand and/or the ball 210 may force the lower aperture 204 to expand in response to the user pulling the ball 210 outward, through the lower aperture 204. Once the ball 210 is substantially through the lower aperture 204, the lower aperture 204 will again contract to prevent any remaining balls 210 in the sleeve 206 from slipping through the holder 200. In addition, the force of gravity will cause any balls 210 remaining in the interior sleeve 206 to move downward, toward the lower aperture 204, so that a user may retrieve the next ball 210 within the golf ball storage system 200, as desired.

In the example arrangement shown in FIGS. 1A through 2C, the golf ball storage system 200 is arranged toward an upper portion on the front of the golf bag 100. This arrangement allows a user to easily access the balls 210 within the golf ball storage system 200 when the golf bag 100 is upright or slightly inclined from an upright position, for instance, in a free standing position on the ground, attached to a cart, etc. The flexible upper and lower apertures 202, 204 remain in a contracted position to prevent balls 210 from falling out of the golf ball storage system 200. However, a user can easily retrieve a ball 210 from the storage system 200, either when the bag 100 is standing or when the bag is being carried on a cart, by inserting one or more fingers into the lower aperture 204 and pulling a ball outward to expand the aperture 204 to accommodate the ball 210.

The golf ball storage system 200 may be located or arranged at any position on the exterior of the golf bag 100. For instance, the holder 200 may be positioned on a lower portion of the golf bag 100, nearer its bottom. In alternate arrangements, the golf ball storage system 200 may be arranged at a middle or upper portion of the golf bag 100, near its top. As yet additional alternatives, if desired, the sleeve 206 may extend essentially the entire length of the golf bag 100 and/or it may extend around the circumference of the golf bag 100 (inside or outside), optionally in a spiraled manner. Other golf ball storage system configurations also are possible.

While various specific examples of structures, constructions, and features of golf club bags and/or golf ball storage devices in accordance with examples of this invention are described above, those skilled in the art will recognize that numerous changes and modifications may be made to these structures without departing from this invention. Various examples of such modifications are described in more detail below in conjunction with FIGS. 3 through 6B.

As described above, the apertures 202 and/or 204 for inserting golf balls into the sleeve 206 and/or for removing golf balls from the sleeve 206 may be made stretchable, expandable, compressible, and/or flexible. In this manner, in their unstressed condition (e.g., when only gravity and/or normal moving forces (e.g., due to walking, carrying the bag, and/or riding with the bag, etc.) are incident on the bag), the aperture(s) will be sufficiently small or closed so as to reliably retain the balls within the storage device, yet they will be readily and sufficiently stretchable, expandable, compressible, and/or flexible so as to allow insertion or removal of balls without undue difficulty (e.g., through positive application of some minimal external force by the user). Any manner of achieving the stretchability, expandability, compressibility, or flexibility may be used without departing from this invention. For example, in some structures, the material forming the border of the aperture 202 and/or 204 will be made from a compressible material so as to allow the force of a pulled or pushed ball to compress the border material a sufficient amount to allow the ball to pass. The compressible material making up the border of the aperture 202 and/or 204 may be, for example, a rubber or foam material, a textile material, other polymeric materials, etc.

Figure 3:
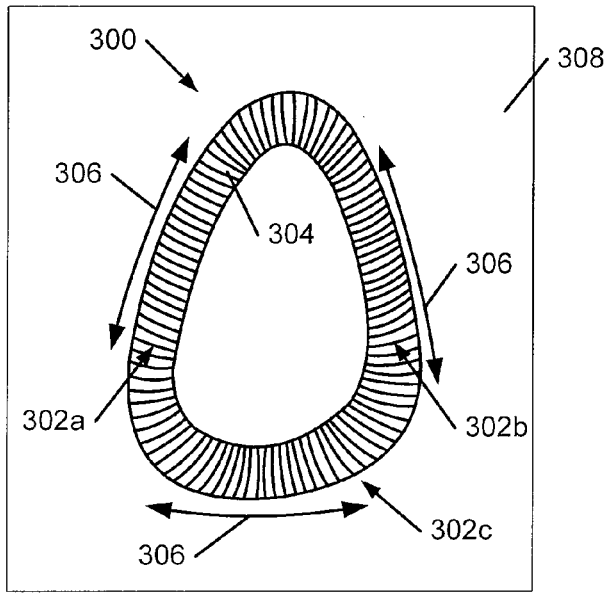
FIG. 3 illustrates various potential and/or alternative features of expandable, stretchable, or flexible apertures that may be used in golf ball storage systems in at least some example golf bag structures according to this invention.

FIG. 3 illustrates another example aperture structure 300. In this example structure 300, at least some portions of the side walls 302*a*, 302*b*, and/or 302*c* of the aperture 300 have an elastic material 304 included therein or thereon to thereby allow one or more of the walls 302*a*, 302*b*, 302*c* to stretch, e.g., in the direction of arrows 306. The elastic material 304 making up the aperture 300 may be made from a rubber, foam, or textile material, e.g., akin to elastic or rubber stretch bands formed in waistbands, wristbands, or other clothing features. The elastic material 304 need not completely extend around the perimeter of the aperture 300. Rather, if desired, one or more expandable sections may be provided around the perimeter, optionally with rigid, unstretchable, or slightly stretchable materials around other portions of the perimeter. Any number of elastic or expandable sections may be provided on a given aperture structure 300 without departing from the invention.

As yet another example, if desired, the aperture 300 size may be sufficiently increased to allow a ball to pass through simply by providing sufficient slack or flexibility in the outer surface of the material from which the aperture 300 is made (or a closely located material). More specifically, as shown in FIG. 3, if the exterior material 308 is sufficiently loose or stretchable, the force bringing a ball into contact with the aperture 300 may be sufficient to cause the aperture walls 302*a*, 302*b*, and/or 302*c* to pull or fold outward or inward (depending on the ball force direction), and thereby opening or increasing the distance between opposing walls a sufficient amount to allow a ball to pass.

Of course, other materials, structures, and/or ways of providing sufficient aperture flexibility, stretchability, compressibility, and/or movement may be used without departing from this invention.

Figure 4:
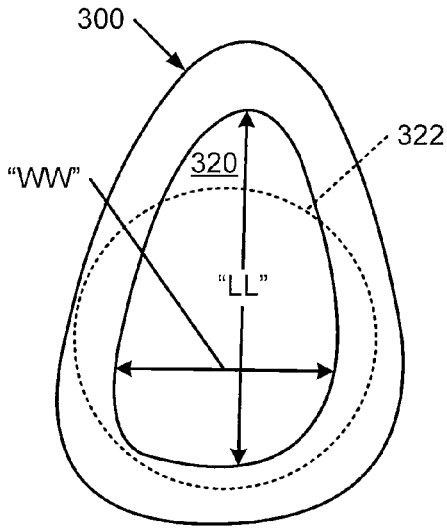
FIGS. 4 and 5 illustrate various example dimensional and/or structural features of expandable, stretchable, or flexible apertures that may be used in golf ball storage systems in at least some example golf bag structures according to this invention.

The aperture size may be varied widely without departing from this invention, depending, for example, on the flexibility or compressibility of the material making up the aperture and/or the surrounding material, the expected temperature range of use, etc. As noted above, desirably, in their unstressed condition (e.g., when only gravity and/or normal moving forces (e.g., due to walking, carrying the bag, and/or riding with the bag, etc.) are incident on the bag), the aperture(s) will be sufficiently small so as to reliably retain the balls in the desired position, yet readily and sufficiently stretchable, expandable, compressible, and/or flexible so as to allow insertion or removal of balls without undue difficulty (e.g., under a positively applied force). For storing golf balls, in accordance with at least some examples of this invention (and as illustrated in FIG. 4), at least one aperture 300 will have its longest dimension (i.e., the longest straight line (or longest longitudinal line "LL") passing through the open area 320 of the aperture 300 of at least 1.75 inches, and in some examples, at least 1.8 inches, at least 2 inches, at least 2.25 inches, or even at least 2.5 inches. If desired, the open area 320 of the aperture 300 will be sufficient so as to allow a user to insert the tip of at least one finger to help grip the ball 322 and pull it outward. In this illustrated example structure 300, however, the widest transverse dimension of the open area 320 (i.e., the longest straight line) in a direction perpendicular to the direction of the longest longitudinal line LL (dimension "WW" in FIG. 4) will be less than a diameter of a golf ball (i.e., less than 1.68 inches), and in some examples, it will be less than 1.65 inches, less than 1.6 inches, less than 1.5 inches, less than 1.4 inches, or even less than 1.25 inches. While they may, the longest longitudinal dimension LL of the aperture 300 need not run perfectly vertical, and the widest transverse dimension WW need not run perfectly horizontal. These dimensions may run in any desired directions on the aperture and/or in the overall golf bag structure without departing from this invention.

As shown in FIG. 4, the aperture 300 of this example structure has a longest dimension of at least 1.75 inches, but, as illustrated, the opening 320 of the aperture 300 is sized and arranged such that, in its unstressed condition, a circle having a diameter of a standard size golf ball (e.g., 1.68 inches, represented by ball 322) will not fully fit within the opening 320 at any position.

Figure 5:
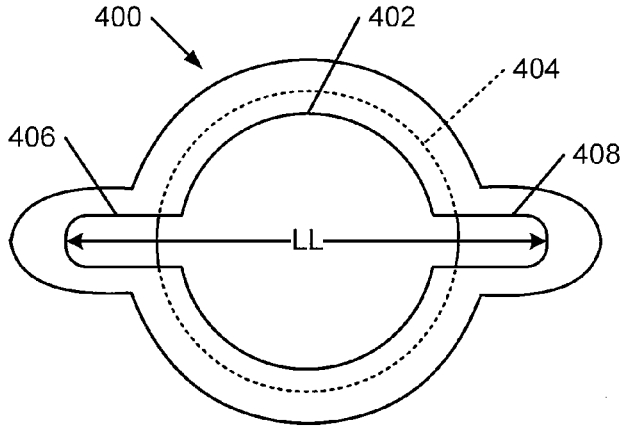

The apertures, however, need not be generally oval, elliptical, or tear-drop shaped, e.g., as shown in various figures above. Rather, any desired aperture structure may be used that has a longest dimension of at least 1.75 inches (optionally with other potential longest dimensions features or ranges, as described above), but with the aperture opening sized and arranged such that, in its unstressed condition, a circle having a diameter of a standard size golf ball (e.g., 1.68 inches, represented by ball 320) will not fully fit within the opening at any position. FIG. 5 illustrates another example aperture structure 400 according to at least some examples of this invention. In this example structure, the aperture 400 generally has a circular structure 402 with a diameter less than that of a standard sized golf ball (represented by ball 404). Other shapes also may be used. In this example structure 400, however, the circular aperture 402 includes two side finger slots 406, and 408 through which a user can reach to help grab the sides of the ball 404. The longest longitudinal length dimension LL in this example structure (from the edge of one finger slot 406, across the central opening, and to the other finger slot 408) is at least 1.75 inches, and in some examples, it may be at least 1.8 inches, at least 2 inches, at least 2.25 inches, or even at least 2.5 inches. The finger slots 406 and 408 may be arranged generally horizontally (as shown in FIG. 5), or they may be arranged at other desired angles without departing from this invention. Also, if desired, the finger slots 406 and 408 need not be precisely aligned, as shown in FIG. 5 (e.g., they may extend from the side edges of the circular region of the aperture at somewhat different angles, on somewhat different lines, etc., without departing from this invention). Of course, other shapes and arrangements for the aperture(s) may be used without departing from this invention.

Figure 6A:
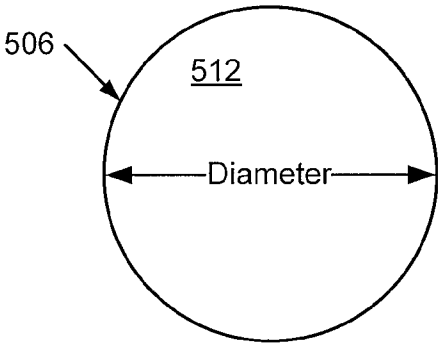
FIGS. 6 through 6B illustrate various example dimensional and/or structural features of apertures and sleeve elements that may be used in golf ball storage systems in at least some example golf bag structures according to this invention.
Figure 6B:
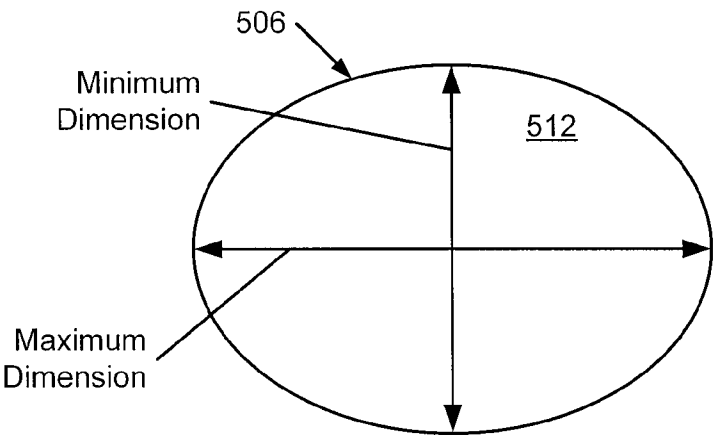
Figure 6:
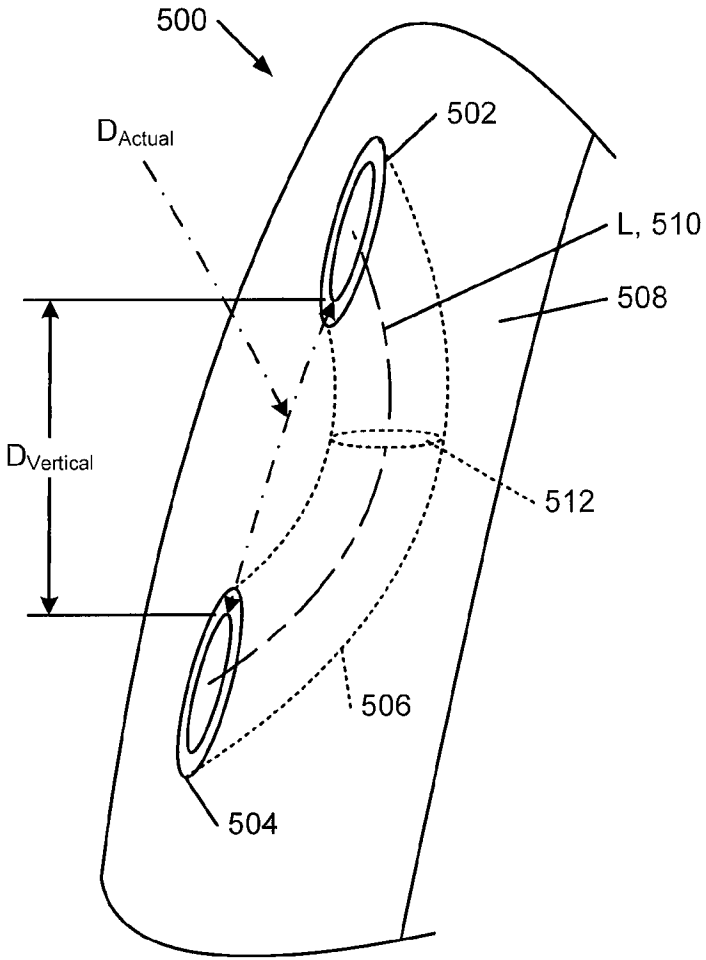

As also described above, the sleeve and apertures for golf ball storage compartments in accordance with this invention also may be arranged in a wide variety of different manners and/or with different specific constructions without departing from this invention. FIG. 6 generally illustrates an arrangement of an upper aperture 502 and a lower aperture 504 with a sleeve 506 extending therebetween. In this example structure, the apertures 502 and 504 are integrally formed in the front portion of a pocket member 508, but in at least some example structures, they also may be formed in the golf bag housing member, fixed to an outer surface of a pocket member or a golf bag housing member, or otherwise incorporated into the overall golf bag structure. 500.

The sleeve 506 may be made from one or more pieces of material, and it may be made from at least some materials independent from the golf bag 500 and/or pocket member 508. Alternatively, if desired, at least some portions or even all portions of the sleeve 506 may be made from materials that make up portions of the golf bag housing, the pocket member 508, or other portions of the golf bag structure 500. If desired, the sleeve 506 may be made from a solid and/or relatively rigid material (such as a rigid plastic tube that extends between aperture 502 and aperture 504). Alternatively, if desired, the sleeve 506 (or at least portions thereof) may be made of a flexible material that may sag or droop when nothing is within it to hold it up.

The dimensions of the sleeve 506 may vary significantly without departing from this invention. For example, the sleeve 506 may define a generally cylindrical shape that extends in an axial direction (the "axial direction" being an axis of the cylinder). As shown in FIG. 6, the axial direction may be curved, although it may be made at least partially straight or angled, if desired. In at least some example structures according to this invention, the longitudinal length L of the sleeve 506, as measured along the center line 510 of the sleeve 506 in the axial direction (e.g., the distance the sleeve 506 extends from the center of one aperture 504, along the axial center line 510, to the end of the sleeve and/or to the center of the other aperture 502) may be at least 1.5 inches, and in some examples, at least 2 inches, at least 2.5 inches, at least 3 inches, at least 4 inches, or even at least 6 inches. Additionally or alternatively, in at least some example structures according to this invention, the longitudinal length L of the sleeve, as measured along the center line 510 of the sleeve 506 in the axial direction (e.g., the distance the sleeve 506 extends from the center of one aperture 504, along the axial center line 510, to the end of the sleeve and/or to the center of the other aperture 502) may be less than 12 inches, and in some examples, less than 10 inches, less than 8 inches, or even less than 6 inches.

When tubular or cylindrically shaped, the sleeve 506 may take on any desired diameter and/or cross sectional size. In accordance with at least some examples of this invention, the sleeve 506 may take on a minimum size of at least the size of a standard golf ball diameter ("BD"), and optionally, at least 1.02×BD, at least 1.05×BD, at least 1.1×BD, at least 1.15×BD, and in some examples, at least 1.20×BD. While there is no theoretical maximum size for the sleeve 506, in order to better maintain the balls in an orderly, easily locatable manner, the sleeve 506 in accordance with at least some example structures according to this invention may take on a maximum size of less than 3×BD, and optionally less than 2.5×BD, less than 2×BD, less than 1.75×BD, and in some examples, less than 1.5×BD.

Sleeves 506 also may take on any desired cross sectional shape without departing from this invention. The cross sectional shape, as determined on a plane perpendicular to the axial direction 510, may be round (see FIG. 6A), elliptical (see FIG. 6B), square (optionally with rounded corners), rectangular (optionally with rounded corners), other polygonal shaped, irregularly shaped, etc. Moreover, the cross sectional shape need not remain constant and/or maintain a constant area over the entire longitudinal length L of the sleeve 506 (e.g., for sleeves made with flexible side walls, etc.). Many variations in the sleeve cross sectional structure are possible without departing from this invention.

The following tables provide examples of absolute values for sleeve minimum and maximum dimensions and/or sleeve area for sleeve structures in accordance with some examples of this invention:

TABLE 1

EXAMPLE MINIMUM DIMENSIONS AND MINIMUM CROSS SECTIONAL AREAS OF SLEEVE WITH RESPECT TO BALL DIAMETER ("BD")

| | Minimum Sleeve Dimension (e.g., a Diameter) | | Minimum Sleeve Cross Sectional Area | |
|---|---|---|---|---|
| Minimum Sleeve Size | Inches (in) | Millimeters (mm) | Square Inches ($in^2$) | Square Millimeters ($mm^2$) |
| ≧1(BD) | 1.68 | 42.67 | 2.22 | 1430 |
| ≧1.02(BD) | 1.71 | 43.53 | 2.30 | 1488 |
| ≧1.05(BD) | 1.76 | 44.81 | 2.43 | 1577 |
| ≧1.1(BD) | 1.85 | 46.94 | 2.69 | 1731 |
| ≧1.15(BD) | 1.93 | 49.07 | 2.93 | 1891 |
| ≧1.2(BD) | 2.02 | 51.21 | 3.21 | 2060 |

TABLE 2

EXAMPLE MAXIMUM DIMENSIONS AND MAXIMUM CROSS SECTIONAL AREAS OF SLEEVE WITH RESPECT TO BALL DIAMETER ("BD")

| | Maximum Sleeve Dimension (e.g., a Diameter) | | Maximum Sleeve Cross Sectional Area | |
|---|---|---|---|---|
| Maximum Sleeve Size | Inches (in) | Millimeters (mm) | Square Inches ($in^2$) | Square Millimeters ($mm^2$) |
| ≦3(BD) | 5.04 | 128.02 | 19.95 | 12,872 |
| ≦2.5(BD) | 4.2 | 106.68 | 13.85 | 8938 |
| ≦2(BD) | 3.36 | 85.34 | 8.87 | 5720 |
| ≦1.75(BD) | 2.94 | 74.68 | 6.79 | 4380 |
| ≦1.5(BD) | 2.52 | 64.01 | 4.99 | 3218 |

As noted above, the sleeves need not have a round cross section. They simply need to be sized such that a golf ball (or other object to be contained) can pass therethrough without difficulty, e.g., under the force of gravity, by one ball (or other object) helping push down another, by a user's finger or hand, etc.

FIG. 6 illustrates another potential feature of aperture arrangements in accordance with at least some examples of this invention. As shown, the lowermost portion of the upper aperture 502 is separated from the uppermost portion of the lower aperture 504 by some distance (labeled $D_{actual}$ in FIG. 6—measured along the surface of the member into and/or on which the apertures are provided, as a direct measurement, etc.). This distance $D_{actual}$ may be at least 1 inch, and in some examples, at least 1.5 inches, at least 2 inches, at least 3 inches, or even at least 4 inches. Additionally or alternatively, if desired, this distance $D_{actual}$ may be less than 12 inches, and in some examples, less than 10 inches, less than 8 inches, less than 6 inches, or even less than 5 inches. The vertical displacement distance ($D_{vertical}$) may be the same as or somewhat less than the actual distances, and the general ranges for this vertical displacement distance may be the same as or somewhat lower than the ranges described above.

Other variations in the overall golf ball storage compartment structure are possible without departing from this invention, including variations described in co-pending U.S. patent application Ser. No. 11/614,388, filed Dec. 21, 2006, in the names of Derek Campbell, Lee Dexheimer, and Christopher Pearson, entitled "Carrying or Storing Devices, Such As Golf Bags, Having Externally. Accessible Storage Systems." This co-pending U.S. patent application is entirely incorporated herein by reference. For example, a relatively narrow sleeve need not extend the complete distance between the upper aperture and the lower aperture. Rather, if desired, the upper aperture may opens into a relatively large open pocket area, and this pocket may taper or funnel down to a sleeve portion at a location near the lower aperture. In this manner, a relatively large number of balls may be stored (as compared to the narrower sleeve), but the balls still can be readily fed to the lower aperture under the force of gravity and are readily available for use without user manipulation of a mechanical closure system. Any desired volume for the large pocket area and/or tapering/funneling construction may be provided without departing from this invention.

Golf bag structures in accordance with at least some examples of this invention need not include two open and exteriorly available apertures in the ball storage system (e.g., one aperture through which balls typically will be inserted into the sleeve for storage and one aperture through which balls typically will be removed from the sleeve for use). Rather, if desired, golf ball storage systems included in golf bag structures in accordance with at least some examples of this invention may include a closed or selectively closable upper aperture (or golf ball inlet aperture). Optionally, if desired, this upper aperture may be closed off, e.g., by a mechanical closure system, such as a zippered closure system, a flap arrangement (e.g., securing the flap using a snap, hook-and-loop, or other mechanical fastener arrangement, etc.), another mechanical fastener arrangement, etc. If desired, the upper aperture (with its optional closure system) may be located within a pocket or other interior chamber provided in the overall golf bag structure 100.

As yet another example, if desired, the upper aperture may be completely omitted from the golf ball storage system without departing from this invention. In such systems, rather than providing both a ball insertion aperture and a ball removal aperture in a golf bag structure, a single aperture (e.g., of the various types described above) may be provided, and golf balls may be both inserted into and removed from the storage sleeve through this single aperture. The sleeve still may be substantially tubular or cylindrical in shape, but it may have a closed off upper end (e.g., akin to a blind hole). This also is not a requirement. Rather, if desired, the upper end of the sleeve (or the space immediately inside the aperture) could allow access to a larger interior pocket chamber, to allow storage of a greater number of balls. Single apertured storage systems of this type may be designed and used to store any desired number of balls without departing from this invention.

Although the external putter and golf ball storage systems described above generally are shown as being integrated into the structure of a golf bag, in an alternate arrangement, these storage systems may be integrated with one another and formed as a separate structure that may be engaged with a separate golf bag structure, either at the factory during golf bag manufacture or as an add-on type accessory, e.g., that could be purchased separately from the golf bag (and indeed attachable to a golf bag). In other words, external putter and golf ball storage systems of this type may be attached to a golf bag (or to another object, such as a golf cart, pull cart, etc.) as an after-market or other separate piece, e.g., using such known attachment means as buckles, snaps, zippers, hook-and-loop fasteners, retaining member structures, adhesives, cements, and the like.

III. CONCLUSION

The present disclosure and the accompanying drawings serve to provide examples of various features and concepts related to the golf bag described, not to limit the scope of the invention. One skilled in the relevant art will recognize that numerous variations and modifications may be made to the arrangements described above without departing from the scope of the present disclosure, as defined by the appended claims.

I claim:

1. A golf bag, comprising:

a base;

one or more wall members extending from the base, wherein the wall member or members define an open end and a chamber for receiving a plurality of golf clubs;

a housing member located outside the chamber, the housing member defining a first aperture that provides access to a space outside the chamber for receiving a putter shaft; and a ball storage compartment located outside the chamber and outside the housing member, wherein the ball storage compartment, the housing member, and the first aperture are arranged such that at least a portion of the space for receiving the putter shaft lies between the chamber and the ball storage compartment, wherein the ball storage compartment includes a second aperture that opens to a ball storage chamber, and wherein a lower portion of the second aperture is wider than an upper portion of the second aperture when the chamber is oriented in an upright manner.

2. A golf bag according to claim 1, wherein the second aperture does not include a mechanical closure system.

3. A golf bag according to claim 2, wherein the ball storage compartment includes a third aperture separate from the second aperture, wherein the third aperture opens to the ball storage chamber.

4. A golf bag according to claim 3, wherein the third aperture does not include a mechanical closure system.

5. A golf bag according to claim 3, wherein the second aperture and the third aperture are connected by a sleeve that forms at least part of the ball storage chamber, wherein the second aperture is deformable between a first position that will not allow a golf ball to pass and a second position that will allow a golf ball to pass, wherein the third aperture is located at a position lower than the second aperture when the chamber is oriented in the upright manner, and wherein the third aperture is deformable between a first position that will not allow a golf ball to pass and a second position that will allow a golf ball to pass.

6. A golf bag according to claim 2, wherein the second aperture is deformable between a first position that will not allow a golf ball to pass and a second position that will allow a golf ball to pass.

7. A golf bag according to claim 1, wherein the housing member is integrally formed on an exterior surface of at least one of the wall members.

8. A golf bag according to claim 1, wherein the housing member is engaged with at least one of the wall members.

9. A golf bag according to claim 1, wherein the ball storage compartment is engaged with an exterior surface of the housing member.

10. A golf bag according to claim 1, wherein the ball storage compartment and the housing member constitute an integral, unitary construction.

11. A golf bag according to claim 10, wherein the integral, unitary construction further defines an insulated chamber that is not open to the ball storage compartment and is not open to the space for receiving a putter shaft.

12. A golf bag according to claim 1, further comprising:

an insulated compartment located outside the chamber for receiving a plurality of golf clubs.

13. A golf bag according to claim 12, wherein the insulated compartment is not open to the ball storage compartment or the space for receiving a putter shaft.

14. A golf bag, comprising:

a main housing defining a main chamber for holding plural golf clubs;

a second housing adjacent an exterior surface of the main housing, wherein the second housing is integrally formed or engaged with the exterior surface of the main housing, and wherein the second housing defines an opening that provides access to a space outside the main chamber for receiving a putter shaft; and a golf ball storage compartment provided at the exterior surface of the main housing, wherein the storage compartment includes a first flexible aperture and a second flexible aperture, the first and second apertures being connected by an internal sleeve, wherein the first aperture is deformable between a first position that will not allow a golf ball to pass and a second position that will allow a golf ball to pass, wherein the second aperture is located at a position lower than the first aperture when the main housing is oriented in an upright manner, wherein the second aperture is deformable between a first position that will not allow a golf ball to pass and a second position that will allow a golf ball to pass, and wherein a lower portion of the second aperture is wider than an upper portion of the second aperture when the main housing is oriented in the upright manner.

15. A golf bag according to claim 14, wherein the second housing is located between the exterior surface of the main housing and the golf ball storage compartment.

16. A golf bag according to claim 14, wherein the golf ball storage compartment defines an insulated chamber that is not open to the sleeve.

17. A golf bag according to claim 14, wherein a lower portion of the first aperture is wider than an upper portion of the first aperture when the main housing is oriented in the upright manner.

18. A golf bag according to claim 14, wherein the first aperture and second aperture are substantially vertically aligned when the housing is oriented in the upright manner.

19. A golf bag according to claim 14, wherein the sleeve is substantially tubular and is arranged in a substantially vertical configuration when the main housing is oriented in an upright manner.

20. A golf bag according to claim 14, wherein the sleeve extends in an axial direction from the first aperture to the second aperture, wherein the sleeve defines an internal open area perpendicular to the axial direction of less than 5 $in^2$.

21. A golf bag according to claim 14, wherein the sleeve extends in an axial direction from the first aperture to the second aperture, wherein the sleeve defines an internal open area perpendicular to the axial direction of at least 2.3 $in^2$.

22. A golf bag according to claim 14, wherein the sleeve extends in an axial direction from the first aperture to the second aperture, wherein the sleeve defines a longitudinal length in the axial direction of at least 1.5 inches.

23. A golf bag according to claim 14, wherein the sleeve extends in an axial direction from the first aperture to the second aperture, wherein the sleeve defines a longitudinal length in the axial direction of at least 3 inches.

24. A golf bag according to claim 14, wherein a distance between a lower portion of the first aperture and the upper portion of the second aperture is at least 1.5 inches.

25. A golf bag according to claim 14, wherein a distance between a lower portion of the first aperture and the upper portion of the second aperture is less than 6 inches.

26. A golf bag, comprising:

a main housing defining a main chamber for holding plural golf clubs;

a second housing adjacent an exterior surface of the main housing, wherein the second housing is integrally formed or engaged with the exterior surface of the main housing, and wherein the second housing defines an opening that provides access to a space outside the main chamber for receiving a putter shaft; and a golf ball storage compartment provided at the exterior surface of the main housing, wherein the storage compartment includes a first aperture, wherein the first aperture defines an opening having a longest longitudinal dimension extending in a first direction and a widest transverse dimension extending in a second direction perpendicular to the first direction, wherein, in an unstressed condition, the longest longitudinal dimension is at least 1.75 inches and the widest transverse dimension is less than 1.65 inches, wherein a lower portion of the first aperture is wider than an upper portion of the first aperture in the transverse direction when the main housing is oriented in an upright manner, and wherein the first aperture is constructed such that: (a) in the unstressed condition, the opening retains a golf ball within the storage compartment against a force of gravity, and (b) when a golf ball located at the opening is exposed to an external, extra-gravitational pulling force, the opening will expand, flex, or move under the pulling force so as to allow the golf ball to pass through the opening.

27. A golf bag according to claim 26, wherein the second housing is located between the exterior surface of the main housing and the golf ball storage compartment.

28. A golf bag according to claim 26, wherein the golf ball storage compartment defines an insulated chamber that is not open to the space for receiving a putter shaft.

29. A golf bag according to claim 26, wherein the storage compartment includes a second aperture, wherein a sleeve extends between the first aperture and the second aperture, and wherein the second aperture includes an opening for introducing a golf ball into the sleeve.

30. A golf bag according to claim 29, wherein the second aperture is located above the first aperture when the main housing is oriented in the upright manner.

31. A golf bag according to claim 29, wherein the first aperture and second aperture are substantially vertically aligned when the main housing is oriented in the upright manner.

32. A golf bag according to claim 26, wherein a ball storage sleeve extends in an axial direction from the first aperture, wherein the sleeve defines an internal open area perpendicular to the axial direction of less than 7 $in^2$.

33. A golf bag according to claim 26, wherein a ball storage sleeve extends in an axial direction from the first aperture, wherein the sleeve defines an internal open area perpendicular to the axial direction of at least 2.4 $in^2$.

34. A golf bag according to claim 26, wherein a ball storage sleeve extends in an axial direction from the first aperture and defines a longitudinal length in the axial direction of at least 1.5 inches.

35. A golf bag according to claim 26, wherein a ball storage sleeve extends in an axial direction from the first aperture and defines a longitudinal length in the axial direction of at least 3 inches.

36. A golf bag according to claim 26, wherein a ball storage sleeve extends in an axial direction from the first aperture and defines a longitudinal length in the axial direction of less than 8 inches.

37. A golf bag, comprising:

a main housing defining a main chamber for holding plural golf clubs;

a second housing adjacent an exterior surface of the main housing, wherein the second housing is integrally formed or engaged with the exterior surface of the main housing, and wherein the second housing defines an opening that provides access to a space outside the main chamber for receiving a putter shaft; and a golf ball storage compartment provided at the exterior surface of the main housing, wherein the storage compartment includes a first aperture providing access to the compartment, wherein a lower portion of the first aperture is wider than an upper portion of the first aperture when the main housing is oriented in an upright manner, wherein the first aperture, in an unstressed condition, defines an opening having a longest dimension of at least 1.75 inches, and wherein, in the unstressed condition, the opening is sized and arranged such that a circle or sphere having a diameter of 1.68 inches will not fully fit within the opening.

38. A golf bag according to claim 37, wherein the second housing is located between the exterior surface of the main housing and the golf ball storage compartment.

39. A golf bag according to claim 37, wherein the golf ball storage compartment defines an insulated chamber that is not open to the space for receiving a putter shaft.

40. A golf bag according to claim 37, wherein the storage compartment includes a second aperture, wherein a sleeve extends between the first aperture and the second aperture, and wherein the second aperture provides an opening for introducing a golf ball into the sleeve.

41. A golf bag according to claim 40, wherein the second aperture is located above the first aperture when the main housing is oriented in the upright manner.

42. A golf bag according to claim 40, wherein the first aperture and second aperture are substantially vertically aligned when the main housing is oriented in the upright manner.

43. A golf bag according to claim 37, wherein a ball storage sleeve extends in an axial direction from the first aperture, wherein the sleeve defines an internal open area perpendicular to the axial direction of less than 7 $in^2$.

44. A golf bag according to claim 37, wherein a ball storage sleeve extends in an axial direction from the first aperture, wherein the sleeve defines an internal open area perpendicular to the axial direction of at least 2.4 $in^2$.

45. A golf bag according to claim 37, wherein a ball storage sleeve extends in an axial direction from the first aperture and defines a longitudinal length in the axial direction of at least 1.5 inches.

46. A golf bag according to claim 37, wherein a ball storage sleeve extends in an axial direction from the first aperture and defines a longitudinal length in the axial direction of at least 3 inches.

47. A golf bag according to claim 37, wherein a ball storage sleeve extends in an axial direction from the first aperture and defines a longitudinal length in the axial direction of less than 8 inches.

48. A golf bag, comprising:

a main housing defining a main chamber for holding plural golf clubs;

a second housing adjacent an exterior surface of the main housing, wherein the second housing is integrally formed or engaged with the exterior surface of the main housing, and wherein the second housing defines an opening that provides access to a space outside the main chamber for receiving a putter shaft; and a golf ball storage compartment provided at the exterior surface of the main housing, wherein the storage compartment includes a first flexible aperture and a second flexible aperture, the first and second apertures being connected by an internal sleeve, wherein the first aperture is deformable between a first position that will not allow a golf ball to pass and a second position that will allow a golf ball to pass, wherein the second aperture is located at a position lower than the first aperture when the main housing is oriented in an upright manner, wherein the second aperture is deformable between a first position that will not allow a golf ball to pass and a second position that will allow a golf ball to pass, and wherein a lower portion of the first aperture is wider than an upper portion of the first aperture when the main housing is oriented in the upright manner.

* * * * *